US005490441A

United States Patent [19]

Hallstrom et al.

[11] Patent Number: 5,490,441

[45] Date of Patent: Feb. 13, 1996

[54] AUTOMATIC RECIPROCATION OF A REVERSIBLE FLUID PRESSURE UNIT AND SWITCHING VALVE THEREFOR

[76] Inventors: Olof A. Hallstrom, 1920 Hallstrom Rd.; Steven A. Hallstrom, 1380 Hallstrom Rd.; Daniel C. Hallstrom, 1910 Hallstrom Rd., all of Tillamook, Oreg. 97141

[21] Appl. No.: 337,788

[22] Filed: Nov. 14, 1994

Related U.S. Application Data

[63] Continuation-in-part of Ser. No. 187,273, Jan. 24, 1994, abandoned.

[51] Int. Cl.[6] ..... F01L 31/02; F01L 25/02

[52] U.S. Cl. ..... 91/338; 91/335; 91/346; 91/308

[58] Field of Search ..... 91/220, 322, 344, 91/335, 346, 337, 338, 426, 281, 304, 308

[56] References Cited

U.S. PATENT DOCUMENTS

| | | | |
|---|---|---|---|
| 393,596 | 11/1888 | Westinghouse, Jr. | 91/426 |
| 1,952,690 | 3/1934 | Strom, Sr. | 91/308 |
| 2,345,433 | 3/1944 | Simpson | 91/338 X |
| 2,689,585 | 9/1954 | Presnell | 91/426 X |
| 2,864,342 | 12/1958 | Ziegelmeyer | 91/337 X |
| 3,148,529 | 9/1964 | Posse et al. | 91/322 X |
| 3,225,663 | 12/1965 | Pelisson | 91/308 X |
| 4,862,919 | 9/1989 | Stemmer | 91/426 X |

*Primary Examiner*—John E. Ryznic
*Attorney, Agent, or Firm*—Olson & Olson

[57] ABSTRACT

A fluid pressure piston-cylinder drive unit is reciprocated automatically by coupling the opposite ends of the cylinder through delivery conduits to a source of fluid pressure and exhaust through a switching valve in which a longitudinally reciprocative spool has a pair of passageways which reversibly couple one end of the cylinder to the source of fluid pressure and the other end of the cylinder to an exhaust conduit. The opposite ends of the switching valve contain shift pistons each of which engages an end of the spool through a coil spring. The shift pistons abut the opposite ends of an elongated rod which extends freely through a bore in the spool. Bypass conduits couple the opposite ends of the cylinder through the delivery conduits one to each end of the valve body such that fluid pressure in one delivery conduit from the source is coupled to one end of the valve body while exhaust fluid pressure from the other delivery conduit is coupled to the other end of the valve body. The exhaust conduit communicates with a detent conduit in which a detent pin is moved by exhaust fluid pressure into a selected detent in the spool to secure the spool against movement. When the piston-cylinder unit is a high volume drive unit, a secondary switching valve is interposed between the cylinder and the primary switching valve to supply high volume fluid pressure to the cylinder by control from the primary switching valve.

23 Claims, 6 Drawing Sheets

AUTOMATIC RECIPROCATION OF A REVERSIBLE FLUID PRESSURE UNIT AND SWITCHING VALVE THEREFOR

CROSS-REFERENCE TO RELATED APPLICATIONS

This application is a continuation-in-part of our application Ser. No. 08/187,273, Filed 24 Jan. 1994, now abandoned.

BACKGROUND OF THE INVENTION

This invention relates to the reciprocation of a fluid pressure drive unit, and more particularly to a switching valve for effecting automatic reciprocation of a fluid pressure piston-cylinder unit.

Automatic reciprocation of an hydraulic or other fluid pressure piston-cylinder unit heretofore has been effected by having the piston rod mechanically operate a valve to switch the fluid back and forth. U.S. Pat. Nos. 4,143,760 and 4,619,819 describe this method. In some instances it is undesirable to have external mechanism to do this shifting. Accordingly, valves have been built to sense the working pressure of the cylinder, and when a preset pressure level slightly higher than the highest working pressure is reached, switching takes place to reverse the motion. U.S. Pat. No. 2,711,717 describes this method. This arrangement works well when the load on the working cylinder is relatively constant and there is only a slight additional pressure rise needed to cause shifting of the valve.

However, the above valve system is undesirable when an uneven load is placed on the cylinder. This is because the valve must be set to switch at a pressure slightly higher than the highest pressure required. When the cylinder has little load on it and needs almost no pressure to operate, but still the valve requires the highest pressure setting in order to switch, there is a major pressure rise at the time of shifting.

To illustrate, when an internal combustion engine is used to drive a fluid pressure pump and there is a maximum load on the cylinder, the engine is working quite hard. Accordingly, the additional slight pressure rise required for shifting the valve above this working pressure will bring about shifting without being noticed. However, if the load diminishes and the engine is working at idle, the requirement of having to build a high pressure to shift the valve may stall the engine before it can throttle up for a full load, or at the least will cause surging of the engine in an undesirable manner.

SUMMARY OF THE INVENTION

In its basic concept, this invention provides a switching valve which functions, upon sensing the reduction of fluid pressure exhaust from a fluid pressure drive unit at the end of a drive movement in one direction, to effect shifting of the switching valve to supply fluid pressure to the drive unit to initiate movement in the opposite direction.

It is the principal objective of this invention to provide for the switching of a fluid pressure drive unit by sensing the reduction in fluid pressure exhaust at the end of movement of the drive unit in either direction of reciprocation.

Another objective of this invention is to provide a switching valve which performs the switching function upon sensing the reduction in fluid pressure exhaust of a fluid pressure drive unit at the end of movement of the drive unit in either direction of reciprocation.

Still another objective of this invention is the provision of an automatically reciprocating fluid pressure piston-cylinder unit.

A further objective of this invention is to provide a fluid pressure switching valve of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
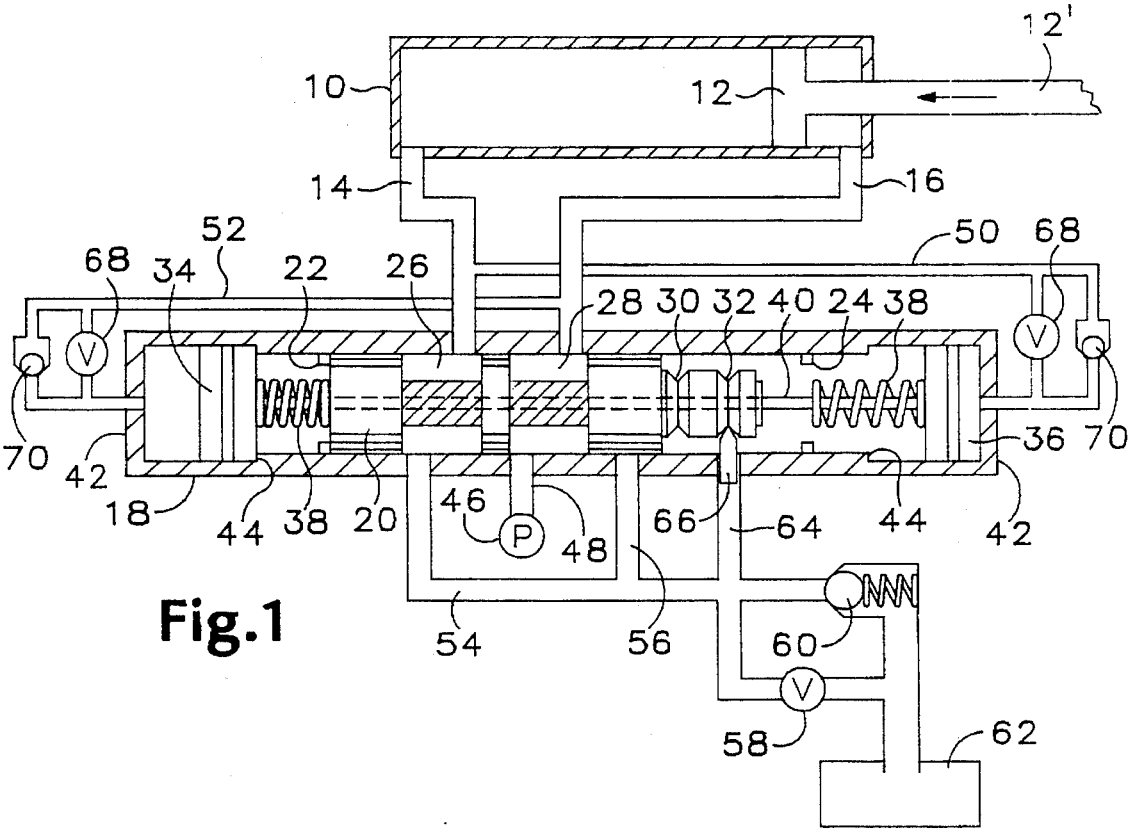
FIGS. 1–6 are longitudinal sectional views of a fluid pressure piston-cylinder unit and a switching valve embodying the features of this invention, showing the positions of components in various stages of a cycle of reciprocation of the piston.

FIGS. 1–6 of the drawings illustrate a fluid pressure piston-cylinder unit the reciprocation of which is to be controlled automatically by the switching valve of this invention. The unit includes an elongated hollow cylinder 10 which houses a piston 12 with piston rod 12' for reciprocation. Fluid pressure, for example hydraulic, is supplied to and exhausted from the cylinder by delivery conduits 14 and 16. These conduits communicate at one of their ends with servicing ports in the opposite ends of the cylinder and at the other of their ends with spaced apart delivery ports in a switching valve body 18.

Within the switching valve body a switching valve spool 20 reciprocates between longitudinally spaced stop rings 22 and 24. The spool is provided with a pair of longitudinally spaced annular grooves 26 and 28 which serve as passageways for fluid to and from the conduits 14 and 16. The spool is secured releasably in selected positions of longitudinal displacement in the valve body by longitudinally spaced annular detents 30 and 32 which cooperate with a detent pin discussed hereinafter.

Longitudinally outward from the stop rings 22 and 24 the opposite end portions of the hollow bore of the valve body 18 contain shift pistons 34 and 36. Each shift piston mounts a coil spring 38 configured to project through the open center of the associated stop ring for abutment with the confronting outwardly facing end of the spool. An elongated rod 40 extends slidably through a longitudinal bore through the spool for abutment at its opposite ends with the confronting inner surfaces of the shift pistons. The opposite ends of the valve body bore are closed by end walls 42, and the shift pistons are reciprocative between said end walls and the inwardly projecting annular shoulders 44 located between the end walls 42 and the stop rings 22 and 24.

A source 46 of fluid under pressure, for example a hydraulic pump, is coupled to the bore of valve body 18 by an inlet port coupled to inlet conduit 48. Fluid pressure is delivered from the source 46 through the inlet conduit 48 and one or the other of the annular passageways 26 and 28 to one or the other of the delivery conduits 14 and 16 to the cylinder 10. As illustrated, fluid pressure from source 46 is delivered to annular spool passageway 26, when the spool is shifted to the right-hand position, and thence through delivery conduit 14 to the piston end of cylinder 10. The piston 12 thus is driven toward the right to extend the piston rod 12' from the cylinder. Exhaust fluid is delivered from the piston rod end of the cylinder through delivery conduit 16 and passageway 28 of the right-shifted spool, to the exhaust system described hereinafter.

Conduit 14 also communicates through bypass conduit 50 with the end of valve body 18 housing shift piston 36. As explained hereinafter, fluid pressure from source 46 is effective to drive shift piston 36 inwardly to move the spool 20 toward the left.

In similar manner, conduit 16 communicates through bypass conduit 52 with the end of the valve body 18 housing shift piston 34. Fluid pressure from source 46 is effective to drive shift piston 34 inwardly to move the spool 20 toward the right.

It is to be noted that exhaust fluid also is delivered from either end of the cylinder 10 through the associated one of the delivery conduits 14 and 16 and the communicating bypass conduit 50 or 52, to the associated shift piston 34 or 36. However, the lower pressure of the exhaust fluid is insufficient to effect inward movement of the shift piston.

Fluid pressure exhaust is communicated from spool passageway 26 to main exhaust conduit 54. Auxiliary exhaust conduit 56 communicates exhaust fluid from spool passageway 28 to main exhaust conduit 54. This main exhaust conduit includes a needle valve 58 for controlling the flow of exhaust fluid to fluid reservoir 62, and a parallel ball relief valve 60 for preventing excessive exhaust fluid pressure build-up in the exhaust conduit.

A detent conduit 64 extends from the main exhaust conduit 54 to the interior of the valve body 18 in alignment with one or the other of the annular detents 30 or 32, depending upon the position of the spool 20. A detent pin 66 is movable in the conduit 64 in response to the magnitude of exhaust fluid pressure in conduit 54, as explained hereinafter. When the detent pin is elevated into engagement with one of the annular detents, the spool 20 is locked to the valve body and thus is secured against longitudinal movement within the valve body.

A needle valve 68 is included in each of the bypass conduits 50 and 52 to control the rate of speed of movement of the associated shift pistons 34 and 36 to prevent shifting of the spool 20 before sufficient exhaust fluid pressure is built up to elevate the detent pin 66 into one of the detents 30 or 32. A parallel ball check valve 70 insures that exhaust fluid passes through the needle valve 68 and also prevents excessive exhaust fluid pressure buildup as the shift pistons retract longitudinally outward.

Operation of the switching valve and automatic reciprocation of the fluid pressure piston-cylinder unit is as follows:

Let it be assumed that the assembly is in the condition illustrated in FIG. 1. Thus, the piston 12 has started movement toward the left end of cylinder 10 by virtue of fluid pressure being delivered from source 46 through annular spool passageway 28 and delivery conduit 16 to the piston rod end of the cylinder 10. This fluid pressure also is delivered through bypass conduit 52 and needle valve 68 to the left end of the switching valve body and to shift piston 34. The latter thus is moved longitudinally inward, slowly as controlled by needle valve 68, causing compression of the spring 38 against the left end of spool 20.

Since exhaust fluid is delivered through delivery conduit 14 and annular spool passageway 26 to exhaust conduit 54, the pressure of the exhaust fluid is impressed against the bottom end of detent pin 66, causing the pin to be elevated into the registering annular detent 32 in spool 20. The spool thus is secured against longitudinal movement toward the right, resisting the pressure of the spring 38 associated with the slowly moving shift piston 34.

Exhaust fluid also is delivered from delivery conduit 14 through bypass conduit 50 and needle valve 68 to the right end of switching valve body 18 and to shift piston 36. However, the pressure of this exhaust fluid is insufficient to effect inward movement of the shift piston against the resistance of shift piston 34 through rod 40.

Figure 2:
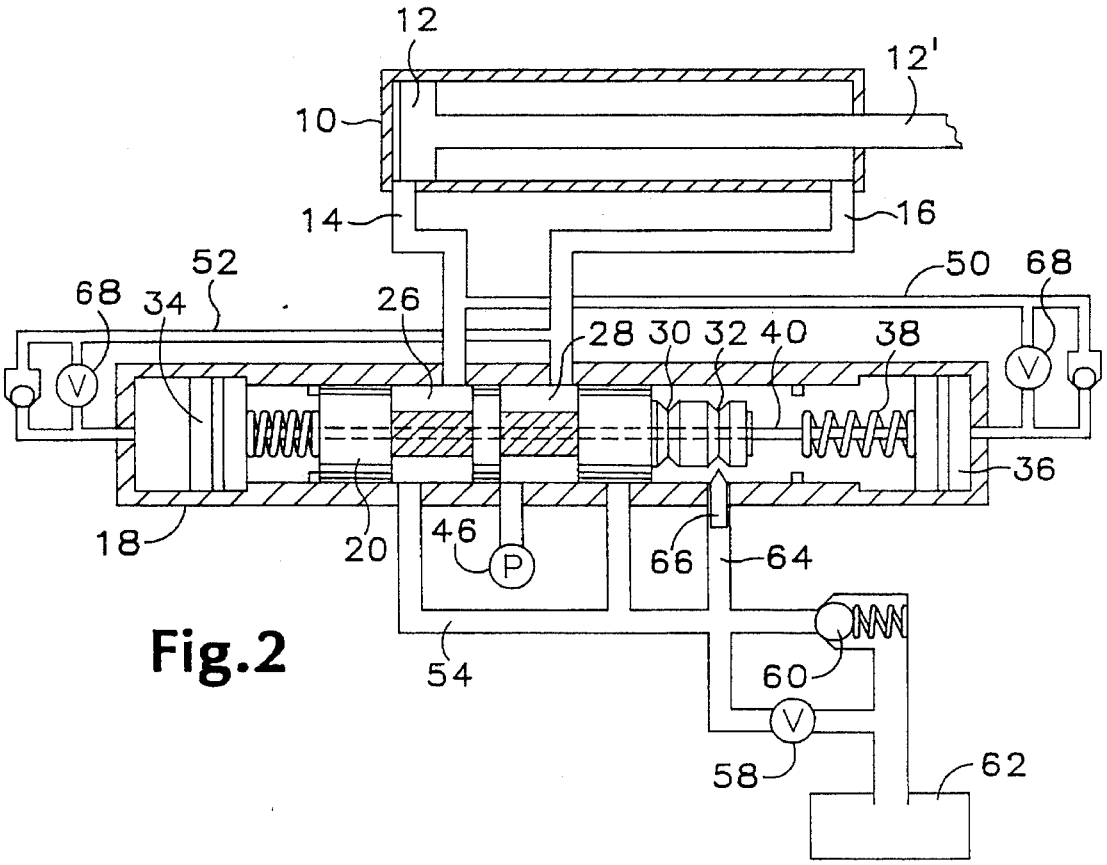

FIG. 2 shows the piston 12 has stopped at the left end of cylinder 10. Since exhaust fluid has ceased to flow in delivery conduit 14 and hence in exhaust conduit 54, the absence of exhaust fluid pressure in detent conduit 64 causes the detent 66 to retract from the annular spool detent 32. Accordingly, the application of fluid pressure from source 46 through bypass conduit 52 to shift piston 34 causes the spring 38 to apply pressure to the spool 20 and move it toward the right until the right-hand end of the spool abuts the stop ring 24. This is the position shown in FIG. 3.

Figure 3:
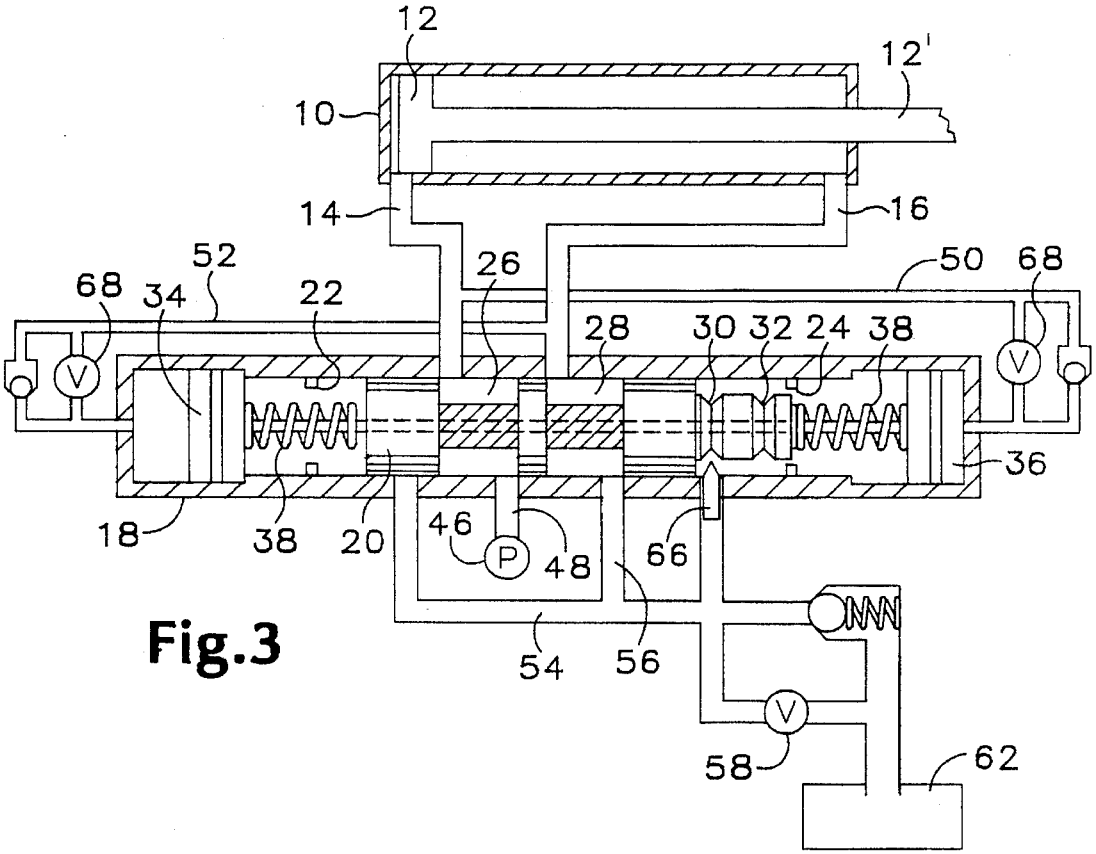

As also shown in FIG. 3, the source 46 of fluid pressure now communicates through inlet conduit 48 and annular spool passageway 26 and thence through delivery conduit 14 to the left, or piston end of cylinder 10. The source of fluid pressure also communicates through bypass conduit 50 and needle valve 68 to the right end of the switching valve body 18 and hence against the shift piston 36. Since needle valve 68 reduces the delivery of fluid pressure to the shift piston 36, the latter has not yet moved inward.

Figure 4:
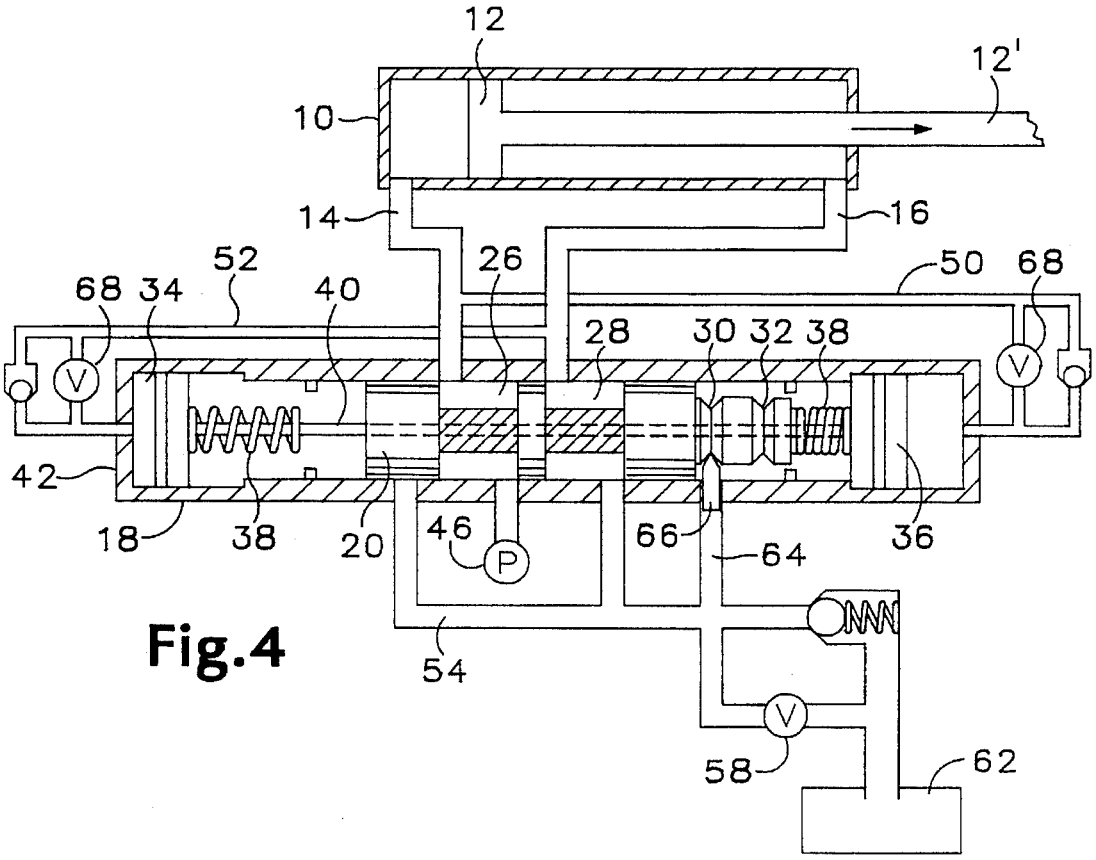

FIG. 4 shows the piston 12 has started movement toward the right in cylinder 10 by fluid pressure from source 46. The resulting exhaust fluid pressure in delivery conduit 16, spool passageway 28, auxiliary exhaust conduit 56 and main exhaust conduit 54 also is applied to the bottom end of detent pin 66 in detent conduit 64. The detent pin thus is elevated into the registering annular detent 30 to secure the spool 20 against movement toward the left, resisting the resilient force of spring 38 associated with shift piston 36 which has been moving slowly inward from the position of FIG. 3 to the position of FIG. 4.

As mentioned hereinbefore, the needle valve 68 serves to slow the movement of shift piston 36 toward the left until exhaust fluid pressure resulting from movement of piston 12 toward the right is sufficient to elevate the detent pin 66 into the annular detent 30 to secure the spool against longitudinal movement.

Shift piston 34 has moved outward to end wall 42 because the force of shift position 36, through rod 40, is greater than the reduced pressure of the exhaust fluid in bypass conduit 52.

Figure 5:
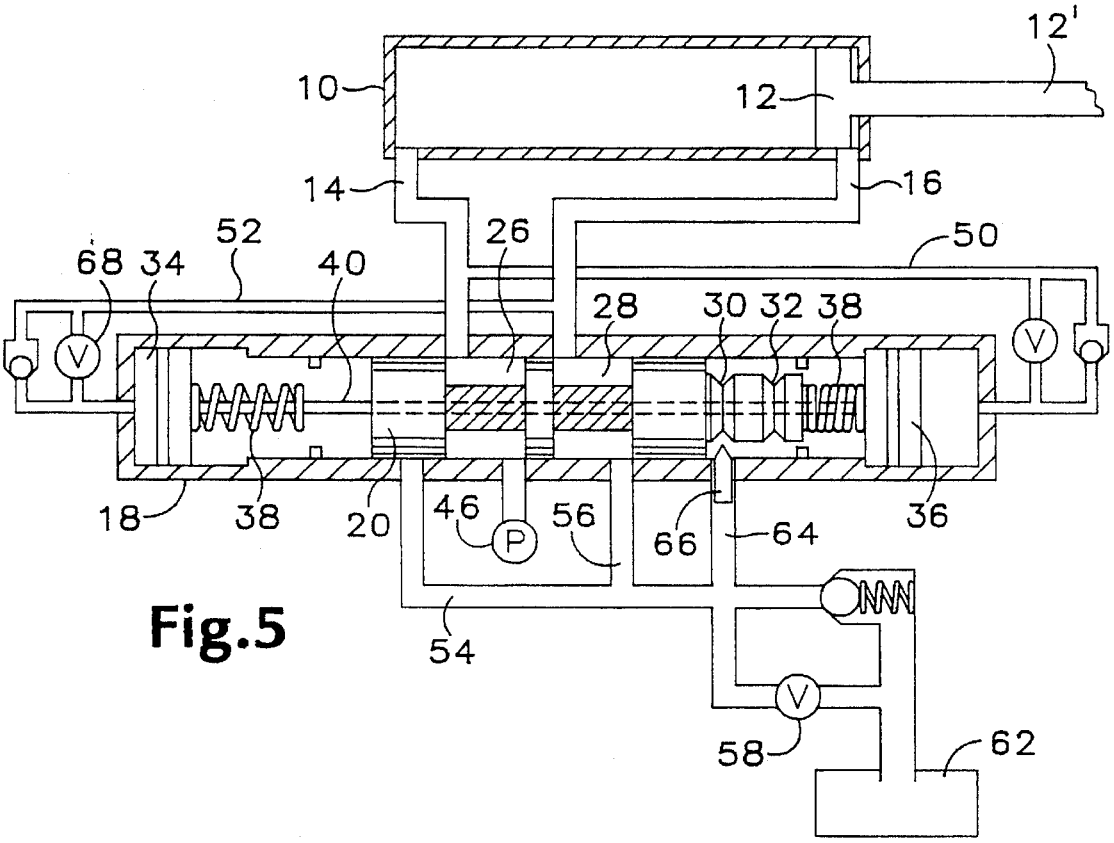

FIG. 5 shows that piston 12 has come to a stop at the right end of cylinder 10. Reduction of exhaust fluid pressure in conduit 16, annular passageway 28, auxiliary conduit 56, main exhaust conduit 54 and detent conduit 64 results in retraction of detent pin 66 from annular detent 30. With fluid pressure from source 46 holding shift piston 36 inward, the associated spring 38 applies force to the right-hand end of spool 20 to move it to the left to the position shown in FIG. 6.

Figure 6:
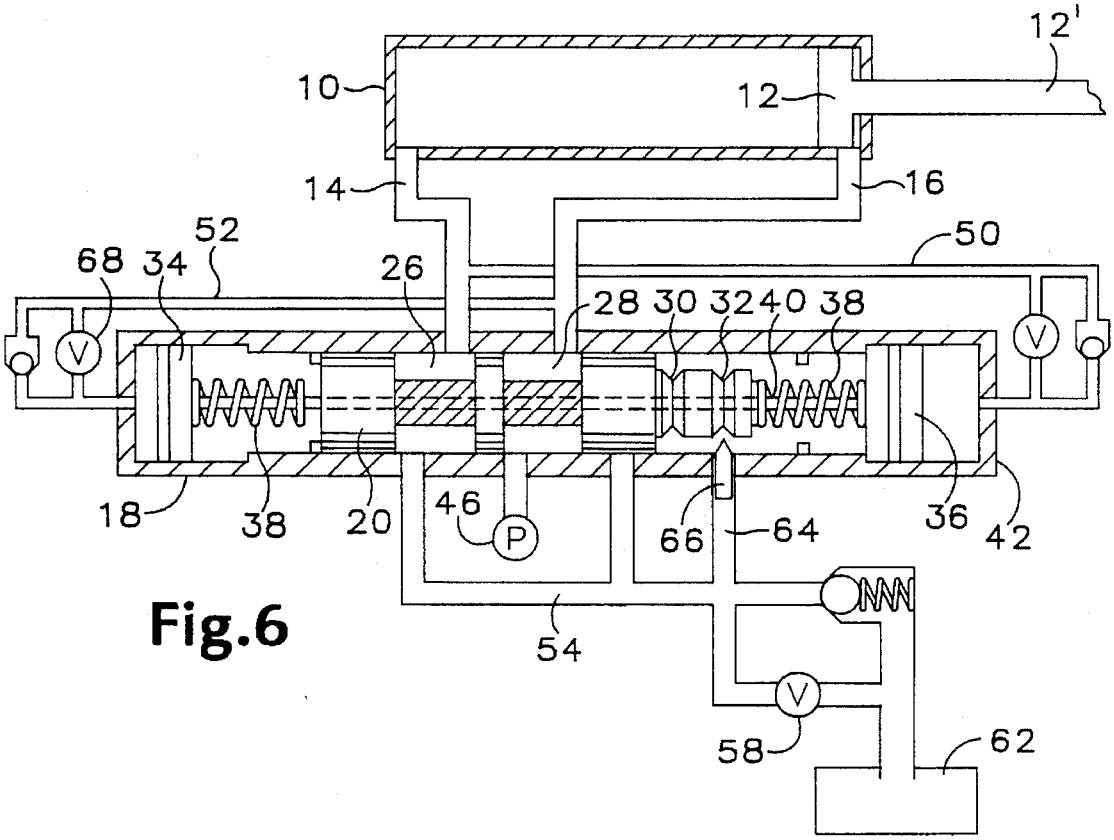

In FIG. 6, fluid pressure from source 46 is applied through conduit 16 to the piston rod end of cylinder 10 and through bypass conduit 52 and needle valve 68 to shift piston 34. Since fluid pressure is metered slowly through needle valve 68, shift piston 34 has not been moved inward. Also, although exhaust fluid pressure is lowered in conduit 14 and bypass conduit 50, shift piston 36 is not yet moved outward to the end wall 42 by rod 40.

The next stage of operation is movement of piston 12 toward the left, by fluid pressure from source 46, with consequent raising of the detent pin 66 into engagement with annular spool detent 32. This is the position shown in FIG. 1 which initiates another cycle of operation of the system.

Figure 7:
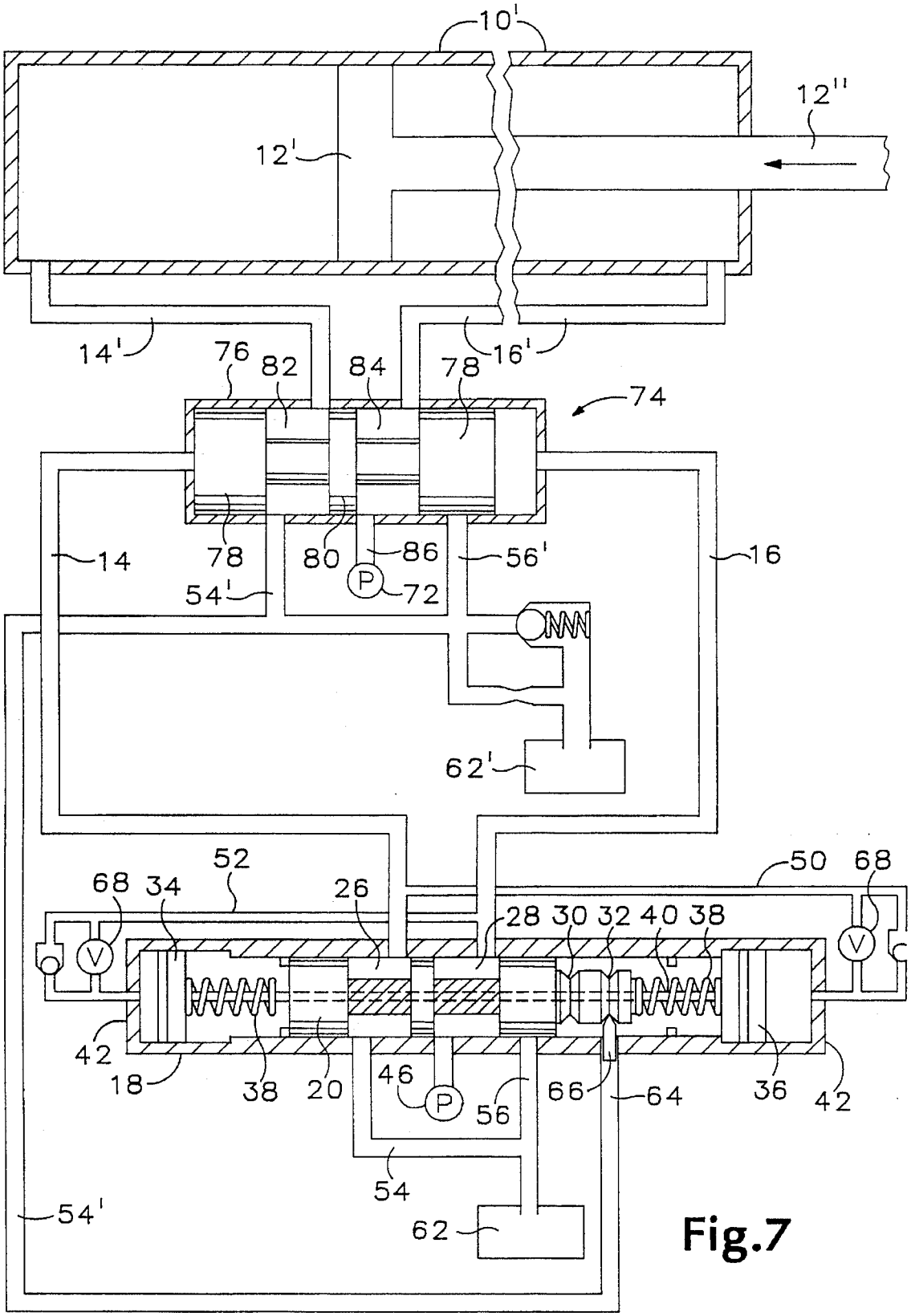
FIG. 7 is a longitudinal sectional view of a high volume fluid pressure piston-cylinder drive unit coupled to a first switching valve for supplying high volume fluid pressure to the cylinder and coupled to a second switching valve of this invention for supplying exhaust fluid pressure to the second switching valve to effect switching of the first switching valve.

FIG. 7 illustrates an arrangement in which a large piston-cylinder unit requires a volume of fluid under pressure that exceeds the capacity of the pump 46 and passageways 26, 28. Accordingly, the primary fluid pressure pump 72 is coupled to the cylinder 10' through a secondary switching valve 74. This valve includes a hollow valve body 76 freely containing a spool for reciprocation therein. The spool is provided with end lands 78 and a central land 80 defining between them the spaced annular passageways 82 and 84. The inlet conduit 86 of the pump 72 is arranged to communicate with each of the passageways one at a time in the opposite positions of reciprocation of the spool.

The piston end of the cylinder 10' communicates through conduit 14' with spool passageway 82, while the piston rod end of the cylinder communicates through conduit 16' with spool passageway 84. Delivery conduit 14 communicates the spool passageway 26 of the switching valve of this invention with the end of valve body 76 adjacent passageway 82. Delivery conduit 16 communicates the spool passageway 28 with the end of valve body 76 adjacent passageway 84. The main exhaust conduit 54' and auxiliary exhaust conduit 56' of the secondary switching valve 74 are coupled to detent conduit 64 containing detent pin 66.

The operation of the system shown in FIG. 7 is as follows: In the condition of FIG. 7, high volume fluid pressure is delivered from pump 72 through spool passageway 84 and delivery conduit 16' to the piston rod end of cylinder 10'. As the piston 12' moves toward the left, exhaust fluid pressure is delivered through conduit 14', spool passageway 82 and exhaust conduit 54' to detent conduit 64. The detent pin 66 thus is elevated into engagement with spool detent 32 to secure the spool 20 in the leftward position illustrated. In this position of the spool 20, fluid pressure from pump 46 is delivered through spool passageway 28 and delivery conduit 16 to the right end of the body 76 of secondary switching valve 74, to maintain the spool in the leftward position illustrated.

When piston 12' reaches the left end of cylinder 10', exhaust fluid pressure drops to zero and hence the detent pin 66 is caused to retract from detent 32. Since fluid pressure from pump 46 is delivered through bypass conduit 52 to the left end of valve body 18 and shift piston 34, the latter is caused to move toward the right. This movement is accompanied by rightward movement of spool 20 through the interposed spring 38, as well as simultaneous rightward movement of rod 40 and shift piston 36. The pump 46 thereupon communicates through spool passageway 26 and conduit 14 with the left end of switching valve body 76, causing the valve spool to move to the right end of the valve body. Pump 72 thus communicates through spool passageway 82 and conduit 14' with the left end of cylinder 10'. The piston 12' thereupon is driven toward the right end of the cylinder.

As the piston moves toward the right, exhaust fluid pressure is directed through conduit 16', spool passageway 84 and exhaust conduits 56' and 54' to detent conduit 64, elevating detent pin 66 into engagement with spool detent 30. The spool thus is secured against movement toward the left.

When piston 12' reaches the right end of cylinder 10', the loss of exhaust fluid pressure in conduit 16' spool passageway 84, exhaust conduits 56' and 54' and detent conduit 64, results in retraction of detent pin 66 from spool detent 30. Since pump 46 delivers fluid pressure through bypass conduit 50 to the right end of spool body 18 and shift piston 36, the latter is caused to move toward the left, moving with it the spring 36, spool 20, rod 40 and shift piston 34. With movement of the spool 20 to the left end abutment 22, the pump 46 delivers fluid pressure through spool passageway 28 and conduit 16 to the right end of secondary switching valve body 76. The spool thus is moved to the left end of the spool body, thereby communicating pump 72 through spool passageway 84 to the right end of cylinder 10'. The associated piston 12' thereupon is caused to move toward the left, as illustrated in FIG. 7. A cycle of operation of the system thus has been completed.

Figures 8, 9:
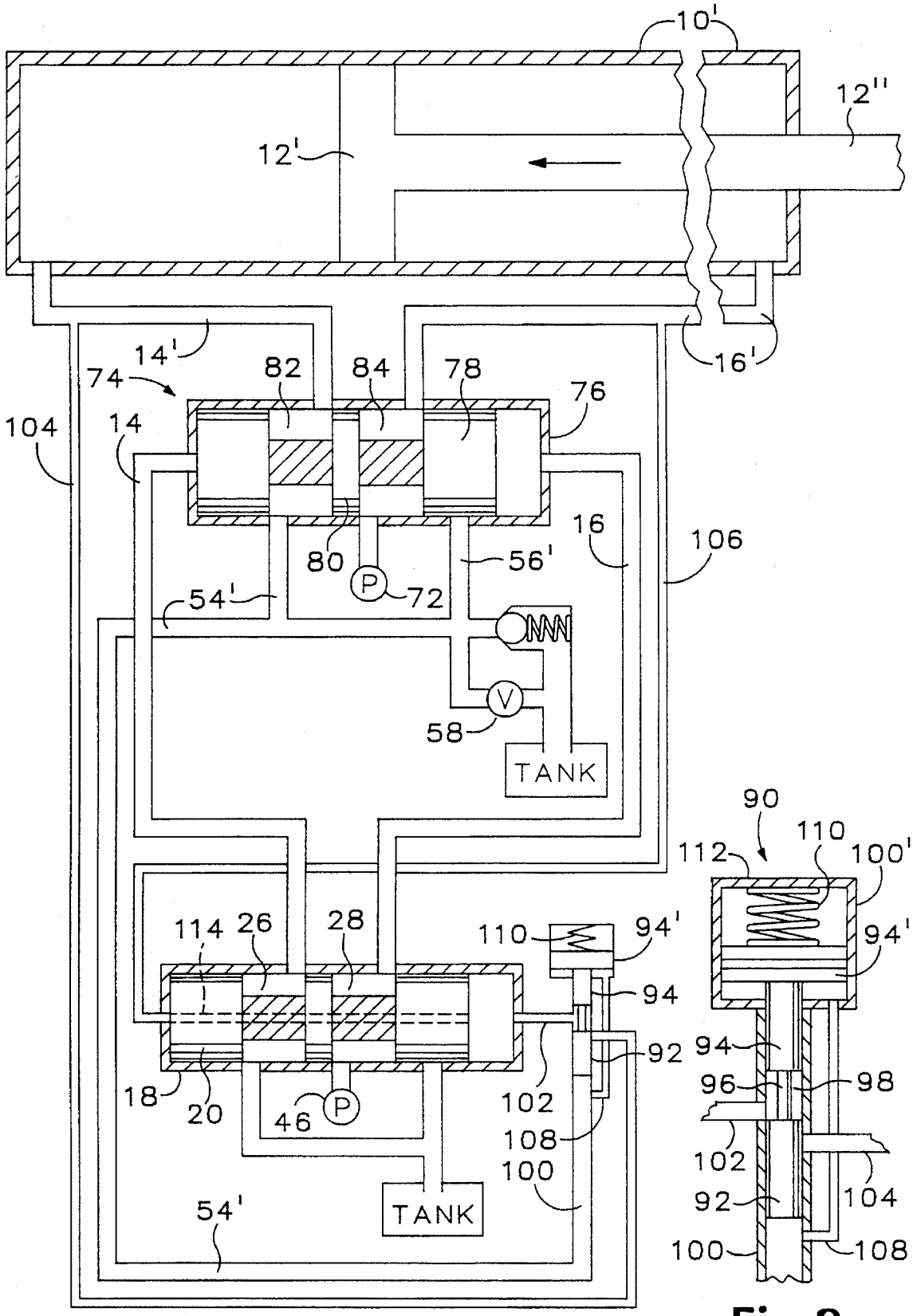
FIG. 8 is a longitudinal sectional view of a modification of the system shown in FIG. 7, the components being arranged with the working piston moving toward the left.
FIG. 9 is a fragmentary sectional view, on an enlarged scale, of the spring-loaded shift control valve shown in FIG. 8.
Figure 10:
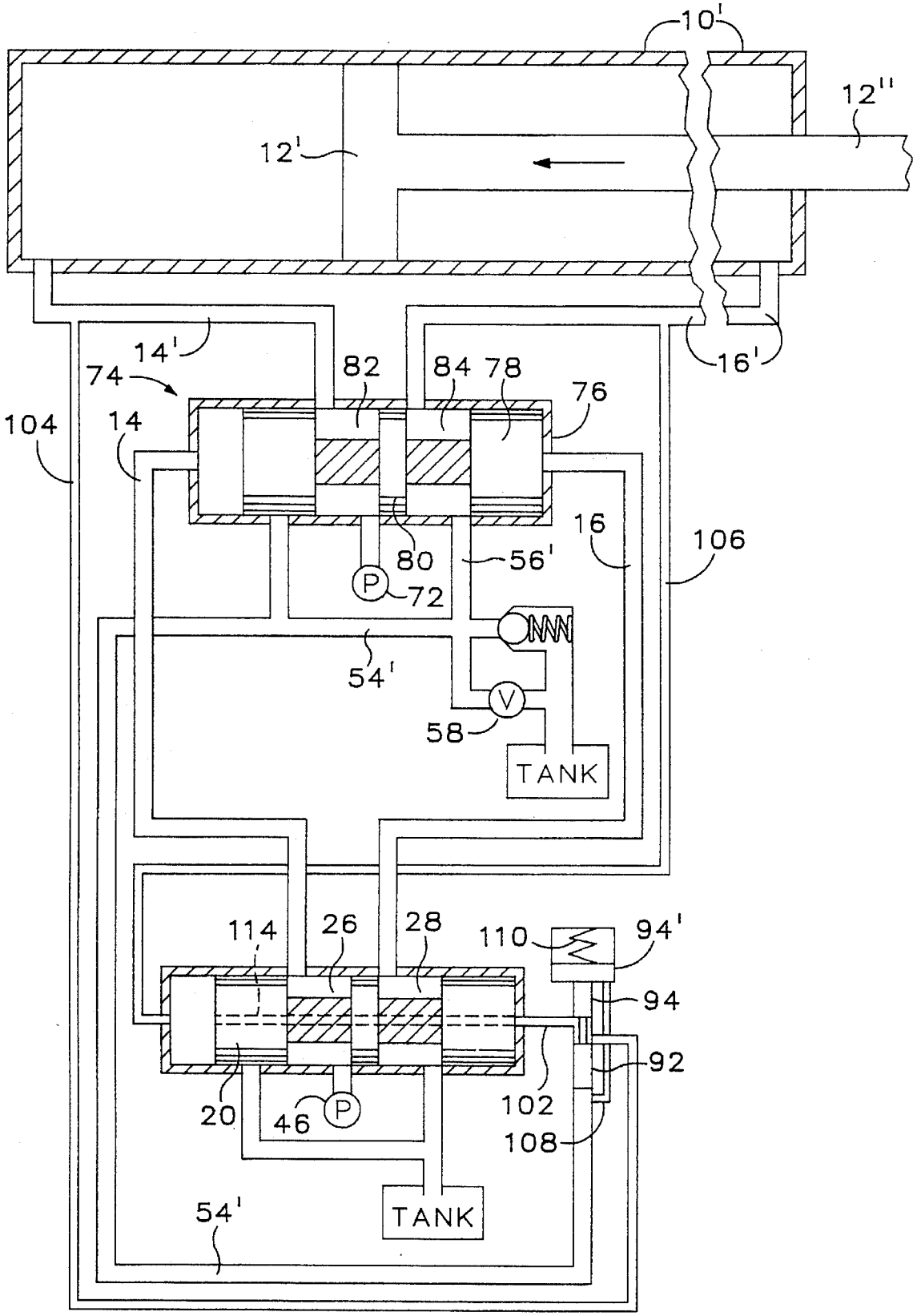
FIG. 10 is a longitudinal sectional view, similar to FIG. 8, showing the arrangement of components with the working piston moving toward the right.

FIGS. 8–10 illustrate a modification of the system shown in FIG. 7, by replacing the assembly of detents 30, 32 and 66, springs 38, rod 40 and shifting pistons 34 and 38, with a shift control valve 90 best shown in FIG. 9. The valve includes a pair of spaced end lands 92 and 94 and a connecting cylinder 96 of reduced diameter, defining an annular passageway 98. The upper land 94 is enlarged in diameter to form a piston 94' contained in the enlarged diameter portion 100' of pipe 100. Pipe 100 is an extension of conduit 54'.

The valve 90 is movable longitudinally in the pipe 100 and enlarged portion 100' between an open position in which the annular passageway 98 connects a pipe 102 communicating with the right end of pilot valve cylinder 18 and a pipe 104 communicating with delivery conduit 14'. Pipe 106 communicates the conduit 16' with the left end of private valve body 18.

A bypass conduit 108 communicates at its lower end with pipe 100 below the end land 92, and at its upper end with the enlarged diameter portion 100' of pipe 100, on the piston rod end of piston 94'. Thus, return fluid pressure is impressed not only on the bottom side of end land 92, but also on the bottom side of piston 94'. This enables the use of a stronger spring 110 interposed between the upper end of piston 94' and the closed end 112 of pipe portion 100' than would be required if the enlarged piston 94' were omitted and the spring were to abut the upper end of the smaller diameter land 94. The provision of a stronger spring contributes to greater accuracy and reliability of performance of the valve 90.

Exhaust fluid pressure from the working cylinder 10' is impressed upon the lower end of valve land 92 and the lower end of piston 94' to move the valve upward in pipe 100, against the resilient resistance of coil spring 110. The valve land 92 closes the adjacent end of pipe 104 from pipe 102 and hence from the right end of pilot valve cylinder 18.

When exhaust fluid pressure from the working cylinder 10' is reduced nearly to zero, when the piston 12' approaches an end of the cylinder, coil spring 110 urges the shift control valve 90 downward in pipe 100 to a position in which the annular passageway 98 communicates the pipes 102 and 104 with each other.

In the preferred embodiment illustrated in FIGS. 8–10, the spool 20 is provided with a small diameter bleed bore 114 through its length to communicate the opposite end spaces of the valve cylinder 18 with each other. The bleed bore allows fluid pressure applied at one end of the cylinder, through pipe 104 or pipe 106, to bleed slowly through the bleed bore to the opposite end space of the cylinder. Both end spaces of the cylinder thus are brought to equal fluid pressure, whereby to prevent creep of the spool 20 in the event of slow leakage of fluid pressure in the cylinder around the spool to exhaust conduit 54 and reservoir 62.

In the operation of the modification of FIGS. 8–10, let it be assumed that the components are in the positions shown in FIG. 8. Thus, fluid pressure from pump 72 is delivered through spool groove 84 and conduit 16– to the right end of working cylinder 10', thereby moving the piston 12' toward the left, as indicated. Exhaust fluid pressure from the left end of cylinder 10' is delivered through conduit 14', spool groove 82 and exhaust conduit 54' to the bottom end of valve land 92. The valve thus is moved upward, against the resistance of spring 110, to close the right end of pilot valve body 18. Accordingly, although fluid pressure from pump 72 is applied through pipe 106 to the left end of valve body 18, the spool 20 is locked by the closed valve 90 against movement to the right.

When the piston 12' reaches the left end of cylinder 10', the reduction in exhaust fluid pressure in exhaust conduit 54' allows coil spring 110 to move the valve downward until the annular passageway 98 connects pipes 102 and 104. Spool 20 thereupon is moved to the right end of valve body 18 by fluid pressure from pump 72 through pipe 106. Fluid pressure from pump 46 thereupon is applied through spool passageway 26 and conduit 14 to the left end of switching valve body 76, causing the spool 78 to move to the right end, as shown in FIG. 10. Fluid pressure from pump 72 then is delivered through spool passageway 82 and delivery conduit 14' to the left end of working cylinder 10'. Piston 12' thereupon is moved toward the right end of cylinder 10', as indicated in FIG. 10.

Exhaust fluid pressure from the right hand of cylinder 10' is delivered through conduit 16', spool passageway 84 and exhaust conduits 54' and 56' to the bottom end of valve land 92, elevating the valve to close the right hand of pilot valve body 18. The pilot valve spool 20 thus is maintained at the right end of valve body 18 even though fluid pressure from pump 72 is delivered through pipe 104.

When the working piston 12' reaches the right end of cylinder 10', the reduced exhaust fluid pressure in exhaust conduit 54' results in lowering of the shift control valve 90 to register the annular passageway 98 with pipes 102 and 104. Fluid pressure from pump 72 thus is applied through pipe 104 to the right end of pilot valve body 18, to move the spool 20 to the left end of the valve body. The cycle of operation thus is completed.

From the foregoing it will be appreciated that operation of the switching valve and consequent automatic reciprocation of the fluid pressure piston-cylinder unit relies upon the sensing of reduced exhaust fluid pressure in detent conduit 64 (FIGS. 1–7) to effect release of the detent pin 66, or upon sensing of reduced exhaust fluid pressure in conduit 100 (FIGS. 8–10) to effect movement of valve 90 to interconnect conduits 102 and 104. This allows moving the spool 20 to its alternate longitudinal position, whereby to direct fluid pressure to the opposite end of the piston 12 and initiate movement of the piston in the opposite direction of reciprocation.

It will be apparent to those skilled in the art that although the foregoing description relates to the automatic reciprocation of a piston-cylinder drive unit, the switching valve of this invention also is operable to effect the automatic reciprocation of a reversible rotary drive unit. It will be recognized that when the movable component within the housing of a rotary drive unit reaches its limit of rotation in one direction, the loss of exhaust fluid pressure in the housing functions to retract the detent pin 66, or movement of valve 90, and allow the valve spool to be moved within the valve body and thereby cause fluid pressure to be directed to the side of the movable component to effect its rotation in the opposite direction.

Similarly, the switching valve of this invention will effect reversal of movement of a piston-cylinder drive unit or reversible rotary drive unit, when the drive unit is subjected to excessive loading. In such instance, the stoppage of movement of the piston or movable component results in loss of exhaust fluid pressure which, in turn, effects retraction of detent pin 66, or movement of valve 90, and switching of the valve spool 20, to reverse the direction of movement of the piston or movable component.

It will be apparent to those skilled in the art that various changes may be made in the size, shape, type, number and arrangements of parts described hereinbefore. For example, the detents 30 and 32 and associated detent pin 66 may be replaced with a brake mechanism or other form of stop mechanism operable by fluid exhaust pressure to engage the spool and secure it against movement. The relief valve 60 may include a screw adjustment for varying the spring pressure of the fluid exhaust acting on the detent pin and the shift pistons. These and other changes may be made, as desired, without departing from the spirit of this invention and the scope of the appended claims.

We claim:

1. In a reversible fluid pressure drive unit wherein a movable component reciprocates in a housing between spaced limits by application of fluid pressure from a source alternately to opposite sides of the movable component and simultaneously exhausting fluid pressure from the side of the movable component toward which said component moves, the method of automatically reciprocating said movable component within said housing, comprising utilizing the lowering of exhaust fluid pressure in the housing when the movable component reaches its limit of movement in one direction within the housing to effect applying fluid pressure to the side of the movable component which will reverse its movement within the housing.

2. The method of claim 1 wherein the lowering of exhaust fluid pressure in the housing when the movable component reaches its limit of movement in one direction within the housing operates a valve to switch the fluid pressure source to apply fluid pressure to the side of the movable component which will reverse its movement within the housing.

3. The method of claim 1 wherein the reciprocating drive unit is a piston-cylinder unit in which a piston reciprocates between longitudinally spaced limits within the opposite ends of a cylinder, and wherein fluid pressure from the source is applied alternately to opposite ends of the cylinder while simultaneously exhausting fluid pressure from the end of the cylinder toward which the piston moves, the method comprising utilizing the lowering of exhaust fluid pressure in the cylinder when the piston reaches its limit of movement in one direction within the cylinder to effect applying fluid pressure to the end of the cylinder which will reverse the movement of the piston within the cylinder.

4. The method of claim 3 wherein the lowering of exhaust fluid pressure in the cylinder when the piston reaches its limit of movement in one direction within the cylinder operates a valve to switch the fluid pressure source to apply fluid pressure to the end of the cylinder which will reverse movement of the piston within the cylinder.

5. A fluid pressure switching valve, comprising:

a) an elongated hollow valve body having closed ends, b) an elongated spool member reciprocative longitudinally in the valve body, c) first and second longitudinally spaced fluid passageways in the spool member, d) first and second fluid pressure delivery ports spaced apart longitudinally in the valve body for registration each with a different one of the first and second fluid passageways in the spool member, the first and second fluid pressure delivery ports being arranged for communication with the opposite sides of the movable component of a reversible fluid pressure drive unit, e) a fluid pressure inlet port in the valve body arranged for registration with the first fluid passageway in the spool member at one limit of longitudinal reciprocation of the spool member and with the second fluid passageway in the spool member at the other limit of longitudinal reciprocation of the spool member, the fluid pressure inlet port being arranged for communication with a fluid pressure source having an exhaust side, f) first and second fluid exhaust ports spaced apart longitudinally in the valve body for registration each with a different one of the first and second fluid passageways in the spool member when the fluid pressure inlet port is in registration with the other of the first and second fluid passageways in the spool member, g) an exhaust conduit communicating with the exhaust ports and arranged for communication with the exhaust side of the fluid pressure source, h) lock means operatively associated with the valve body and spool member and operable by exhaust fluid pressure in the exhaust conduit to lock the spool member against reciprocation within the valve body and operable when exhaust fluid pressure is absent in the exhaust conduit to release the spool member for movement within the valve body, and i) means communicating the opposite ends of the valve body alternately with a source of fluid pressure for reciprocating the spool member.

6. The fluid pressure switching valve of claim 5 including a pair of longitudinally spaced spool stop members in the valve body defining the limits of longitudinal reciprocation of the spool member within the valve body.

7. The fluid pressure switching valve of claim 5 wherein the lock means comprises:

a) a pair of longitudinally spaced detents on the spool member, b) a detent pin bore extending through the valve body and arranged for registration with each of the detents when the spool member is moved to the alternate limits of longitudinal reciprocation within the valve body, the detent pin bore communicating with the exhaust conduit, and c) a detent pin movable in the detent pin bore for extension into the registering detent when exhaust fluid pressure is present in the exhaust conduit and for retraction from the registering detent when exhaust fluid pressure is absent from the exhaust conduit.

8. The fluid pressure switching valve of claim 5 wherein the means communicating the opposite ends of the valve body alternately with a source of fluid pressure comprises a first conduit communicating one end of the valve body with a source of fluid pressure, and a second conduit communicating the opposite end of the valve body with the source of fluid pressure, and the lock means comprises valve means in the second conduit operable by exhaust fluid pressure to close said second conduit and operable when exhaust fluid pressure is absent to open said second conduit.

9. The fluid pressure switching valve of claim 5 wherein the means communicating the opposite ends of the valve body alternately with a source of fluid pressure comprises operator means actuated by fluid pressure at one of the first and second fluid pressure delivery ports to shift the spool member to switch the fluid pressure to the other of said first and second fluid pressure delivery ports when the spool member is released by the lock means.

10. The fluid pressure switching valve of claim 9 wherein the operator means comprises:

a) a shift piston in each of the spaces between the ends of the spool member and the associated closed end of the valve body, b) a shift piston stop member in each of said spaces, each shift piston stop member and associated closed end of the valve body defining the limits of longitudinal reciprocation of the shift piston, and c) connecting means operatively interengaging the shift pistons for moving one shift piston longitudinally outward in its space when the other shift piston is moved longitudinally inward in its space, whereby to effect movement of the spool member in the direction toward the outwardly moved shift piston.

11. The fluid pressure switching valve of claim 10 wherein the connecting means comprises:

a) a first bypass conduit communicating the first fluid pressure delivery port with the end space in the valve body containing the shift piston which effects movement of the spool member to communicate the fluid pressure inlet port with the second fluid pressure delivery port, and b) a second bypass conduit communicating the second fluid pressure delivery port with the end space in the valve body containing the shift piston which effects movement of the spool member to communicate the fluid pressure inlet port with the first fluid pressure delivery port.

12. The fluid pressure switching valve of claim 11 including an elongated rod,extending freely through the spool member and abutting the shift pistons, and a spring encircling the rod between each shift piston and the associated end of the spool member, each spring being configured to be compressed when the associated shift piston is moved inward and the spool member is secured at its limit position adjacent said shift piston.

13. An automatically reciprocative fluid pressure drive unit, comprising the combination of a switching valve of claim 5 and a reversible fluid pressure drive unit having a movable component reciprocative within and relative to a housing, the housing having fluid pressure servicing ports communicating with opposite sides of the movable component at the opposite ends of reciprocation of said movable component and communicating with the first and second fluid pressure delivery ports in the switching valve body.

14. The combination of claim 13 wherein the reversible fluid pressure drive unit is a piston-cylinder drive unit having a cylinder and a piston with attached piston rod reciprocative within and relative to the cylinder, the cylinder having fluid pressure servicing ports at the opposite ends thereof communicating with the first and second fluid pressure delivery ports in the switching valve body.

15. The combination of claim 13 including a secondary switching valve comprising:

a) an elongated hollow valve body having closed ends, b) an elongated spool member reciprocative longitudinally in the valve body, c) first and second longitudinally spaced fluid passageways in the spool member, d) first and second fluid pressure delivery ports spaced apart longitudinally in the valve body for registration each with a different one of the first and second fluid passageways in the spool member, the first and second fluid pressure delivery ports being arranged for communication with the opposite sides of the movable component of a reversible fluid pressure drive unit, e) a fluid pressure inlet port in the valve body arranged for registration with the first fluid passageway in the spool member at one limit of longitudinal reciprocation of the spool member and with the second fluid passageway in the spool member at the other limit of longitudinal reciprocation of the spool member, the fluid pressure inlet port being arranged for communication with a fluid pressure source having an exhaust side, f) first and second fluid exhaust ports spaced apart longitudinally in the valve body for registration each with a different one of the first and second fluid passageways in the spool member when the fluid pressure inlet port is in registration with the other of the first and second fluid passageways in the spool member, g) an exhaust conduit communicating the exhaust ports with the lock means of the first named switching valve, and h) first and second connecting conduits communicating the first and second fluid pressure delivery ports of the first named switching valve with the opposite ends of the hollow body of the secondary switching valve.

16. The combination of claim 15 wherein the reversible fluid pressure drive unit is a piston-cylinder drive unit having a cylinder and a piston with attached piston rod reciprocative within and relative to the cylinder, the cylinder having fluid pressure servicing ports at the opposite ends thereof communicating with the first and second fluid pressure delivery ports in the secondary switching valve body.

17. An automatically reciprocative fluid pressure drive unit, comprising the combination of a) a reversible fluid pressure drive unit having a movable component reciprocative within and relative to a housing, b) fluid pressure servicing ports in the housing communicating with opposite sides of said movable component at the opposite ends of reciprocation of said movable component, c) a fluid pressure switching valve, comprising:

1) an elongated hollow valve body having closed ends, 2) an elongated spool member reciprocative longitudinally in the valve body, 3) first and second longitudinally spaced fluid passageways in the spool member, 4) first and second fluid pressure delivery ports spaced apart longitudinally in the valve body for registration each with a different one of the first and second fluid passageways in the spool member, 5) a fluid pressure inlet port in the valve body arranged for registration with the first fluid passageway in the spool member at one limit of longitudinal reciprocation of the spool member and with the second fluid passageway in the spool member at the other limit of longitudinal reciprocation of the spool member, the fluid pressure inlet port being arranged for communication with a fluid pressure source having an exhaust side, 6) first and second fluid exhaust ports spaced apart longitudinally in the valve body for registration each with a different one of the first and second fluid passageways in the spool member when the fluid pressure inlet port is in registration with the other of the first and second fluid passageways in the spool member, 7) an exhaust conduit communicating with the exhaust ports and arranged for communication with the exhaust side of a fluid pressure source, 8) lock means operatively associated with the valve body and spool member and operable by exhaust fluid pressure in the exhaust conduit to lock the spool member against reciprocation within the valve body and operable when exhaust fluid pressure is absent in the exhaust conduit to release the spool member for movement within the valve body, 9) means communicating the opposite ends of the valve body alternately with a source of fluid pressure for reciprocating the spool member, d) a secondary switching valve comprising:

1) an elongated hollow valve body having closed ends, 2) an elongated spool member reciprocative longitudinally in the valve body, 3) first and second longitudinally spaced fluid passageways in the spool member, 4) first and second fluid pressure delivery ports spaced apart longitudinally in the valve body for registration each with a different one of the first and second fluid passageways in the spool member, the first and second fluid pressure delivery ports communicating with the opposite sides of the reversible fluid pressure drive unit, 5) a fluid pressure inlet port in the valve body arranged for registration with the first fluid passageway in the spool member at one limit of longitudinal reciprocation of the spool member and with the second fluid passageway in the spool member at the other limit of longitudinal reciprocation of the spool member, the fluid pressure inlet port being arranged for communication with a fluid pressure source having an exhaust side, 6) first and second fluid exhaust ports spaced apart longitudinally in the valve body for registration each with a different one of the first and second fluid passageways in the spool member when the fluid pressure inlet port is in registration with the other of the first and second fluid passageways in the spool member, 7) an exhaust conduit communicating the exhaust ports with the lock means of the switching valve, and 8) first and second connecting conduits communicating the first and second fluid pressure delivery ports of the switching valve with the opposite ends of the hollow body of the secondary switching valve.

18. The combination of claim 17 wherein the fluid pressure switching valve includes a pair of longitudinally spaced spool stop members in the valve body defining the limits of longitudinal reciprocation of the spool member within the valve body.

19. The combination of claim 17 wherein the lock means comprises:

a) a pair of longitudinally spaced detents on the spool member, b) a detent pin bore extending through the valve body and arranged for registration with each of the detents when the spool member is moved to the alternate limits of longitudinal reciprocation within the valve body, the detent pin bore communicating with the exhaust conduit, and c) a detent pin movable in the detent pin bore for extension into the registering detent when exhaust fluid pressure is present in the exhaust conduit and for retraction from the registering detent when exhaust fluid pressure is absent from the exhaust conduit.

20. The combination of claim 17 wherein the means communicating the opposite ends of the valve body with a source of fluid pressure comprises a first conduit communicating one end of the valve body with a source of fluid pressure, and a second conduit communicating the opposite end of the valve body with a source of fluid pressure, and the lock means comprises valve means in the second conduit operable by exhaust fluid pressure to close said second conduit and operable when exhaust fluid pressure is absent to open said second conduit.

21. The fluid pressure switching valve of claim 17 wherein the means communicating the opposite ends of the valve body alternately with a source of fluid pressure comprises operator means actuated by fluid pressure at one of the first and second fluid pressure delivery ports to shift the spool member to switch the fluid pressure to the other of said first and second fluid pressure delivery ports when the spool member is released by the lock means.

22. The combination of claim 21 wherein the operator means comprises:

a) a shift piston in each of the spaces between the ends of the spool member and the associated closed end of the valve body, b) a shift piston stop member in each of said spaces, each shift piston stop member and associated closed end of the valve body defining the limits of longitudinal reciprocation of the shift piston, and c) connecting means operatively interengaging the shift pistons for moving one shift piston longitudinally outward in its space when the other shift piston is moved longitudinally inward in its space, whereby to effect movement of the spool member in the direction toward the outwardly moved shift piston.

23. The combination of claim 22 wherein the connecting means comprises:

a) a first bypass conduit communicating the first fluid pressure delivery port with the end space in the valve body containing the shift piston which effects movement of the spool member to communicate the fluid pressure inlet port with the second fluid pressure delivery port, and b) a second bypass conduit communicating the second fluid pressure delivery port with the end space in the valve body containing the shift piston which effects movement of the spool member to communicate the fluid pressure inlet port with the first fluid pressure delivery port.

* * * * *